US005752428A

United States Patent [19]

Jepsen

[11] Patent Number: 5,752,428

[45] Date of Patent: May 19, 1998

[54] HYDRAULIC AXIAL PISTON MOTOR

[75] Inventor: Hardy Peter Jepsen, Nordborg, Denmark

[73] Assignee: Danfoss A/S, Nordborg, Denmark

[21] Appl. No.: 656,189

[22] PCT Filed: Dec. 1, 1994

[86] PCT No.: PCT/DK94/00448

§ 371 Date: Jul. 24, 1996

§ 102(e) Date: Jul. 24, 1996

[87] PCT Pub. No.: WO95/16132

PCT Pub. Date: Jun. 15, 1995

[30] Foreign Application Priority Data

Dec. 8, 1993 [DE] Germany ..... 43 41 850.3

[51] Int. Cl.[6] ..... F01B 1/06

[52] U.S. Cl. ..... 91/499; 417/269; 92/57; 92/71

[58] Field of Search ..... 91/499; 417/269; 92/57, 71

[56] References Cited

U.S. PATENT DOCUMENTS

| | | | |
|---|---|---|---|
| 1,860,278 | 5/1932 | Eckels | 417/269 |
| 2,992,619 | 7/1961 | Nilges | 91/499 |
| 3,187,644 | 6/1965 | Ricketts | 92/57 |
| 5,247,794 | 9/1993 | Benson et al. | 92/57 |

*Primary Examiner*—Charles G. Freay
*Assistant Examiner*—Cheryl J. Tyler
*Attorney, Agent, or Firm*—Lee, Mann, Smith, McWilliams, Sweeney & Ohlson

[57] ABSTRACT

A hydraulic axial piston motor (1) is disclosed, having a cylinder drum (4) which is connected, so that it is non-movable axially, to a shaft (3) and so that they rotate together, and which has at least one cylinder (5), for each cylinder a piston (6) arranged in the cylinder, which piston bears at its end projecting from the cylinder drum (4) against a swash plate (8) via the intermediary of a slider shoe (7), a pressure-applying arrangement (9) for holding at least one slider shoe (7) against the swash plate and a control plate (12) with control kidneys. It is desirable for such a motor to be reliably operable even when the shaft is provided with axial play. Leakages in particular are to be avoided. For that purpose, the pressure-applying device (9) is mounted so as to e axially movable relative to the cylinder drum (4). A pressure plate (13) that is axially movable relative to the cylinder drum (4) is arranged between the control plate (12) and the cylinder drum (4), this pressure plate having for each cylinder a through-opening (14) which is connected in a fluid-tight manner to the cylinder (5). Furthermore, between the pressure-applying device (9) and the pressure plate (13) there is provided an expanding device (18) which acts on the pressure-applying device (9) and the pressure plate (13) with oppositely directly forces.

2 Claims, 2 Drawing Sheets

HYDRAULIC AXIAL PISTON MOTOR

BACKGROUND OF THE INVENTION

The invention relates to a hydraulic axial piston motor having a cylinder drum which is connected, so that it is non-movable axially, to a shaft and so that they rotate together, and which has at least one cylinder, for each cylinder a piston arranged in the cylinder, which piston bears at its end projecting from the cylinder drum against a swash plate via the intermediary of a slider shoe, a pressure-applying arrangement for holding at least one slider shoe against the swash plate and a control plate with control "kidneys".

The cylinder drum of an axial piston motor is one of the essential parts involved in producing the torque on the shaft. U.S. Pat. No. 4,771,676 therefore discloses two possibilities for fixing the cylinder drum on the shaft: firstly, a splined connection and, secondly, construction of the cylinder drum and shaft in one piece. The splined connection does allow an axial movement of the cylinder drum and shaft relative to one another, but in the case of an axial displacement it is obviously impossible to ensure freedom of movement also between the cylinder drum and the shaft in the circumferential direction to the necessary extent; as a result, rattling can occur here.

Conversely, in the normal production of motors, it is impossible to install without axial play a shaft that has been made in a relatively large production run. This play can be kept very small, but in the case of an axially non-movable connection between the cylinder drum and the shaft, internal leakage of the motor may occur on axial movement of the shaft, namely, either in the region of the control plate, when the cylinder drum lifts away from the control plate, or in the region of the swash plate, when the slider shoes lift away from the swash plate. An axial displacement of the shaft can occur, for example, when the motor is coupled by way of a helical gearing to a work machine to be driven. Another problematical case involves the operation of the motor in an installation in which the shaft is vertical. Such configurations can result in the motor failing to start because the pressure build-up required for this does not reach as far as the cylinder; on the contrary, the hydraulic fluid flows prematurely through drainage channels.

SUMMARY OF THE INVENTION

The invention is therefore based on the problem of providing a motor which can be operated reliably even with a shaft predisposed to axial play.

In the case of a motor of the kind mentioned in the introduction, this problem is solved in that the pressure-applying device is mounted so as to be axially movable relative to the cylinder drum, that between the control plate and the cylinder drum there is arranged a pressure plate that is axially movable relative to the cylinder drum, this pressure plate having for each cylinder a through-opening which is connected in a fluid-tight manner to the cylinder, and that between the pressure-applying device and the pressure plate there is provided an expanding device which acts on the pressure-applying device and the pressure plate with oppositely directed forces.

By that means, irrespective of the axial position of the shaft, which is at the same time the deciding factor for the axial position of the cylinder drum, one can ensure that both in the region of the control plate and in the region of the swash plate the engagement of the relevant elements with respect to one another is reliably sealed. These elements are, in the region of the swash plate, the slider shoes, which are kept permanently in engagement with the swash plate by the pressure-applying device, so that they are not able to tilt. If they were to tilt, on the one hand undesirable losses due to leakage would occur, and on the other hand the control behaviour of the motor would be severely disrupted. Since the pressure-applying device is axially movable with respect to the shaft, but on the other hand is loaded by the expanding device permanently in the direction towards the swash plate with a force, this contact pressure is then independent of the axial position of the shaft. In the region of the control plate, the seal is now provided by the pressure plate, which is also permanently loaded by the expanding device with a force that holds it in engagement with the control plate. The shaft is likewise axially movable with respect to the pressure plate so that the axial position of the shaft has no influence on the axial position of the pressure plate. The actual fluid connection between the cylinder or cylinders and the control plate is effected through the through-openings in the pressure plate, with which the cylinder is connected in a fluid-tight manner. Even if the cylinder drum lifts away from the pressure plate, which is expressly allowed, the expanding device ensures that the pressure plate lies in sealed engagement against the control plate, thus providing, as it were, a leak-free path from the control plate to the interior of the cylinder. An axial movement of the shaft and consequently an axial movement of the cylinder drum is therefore allowed, without the seal being impaired. The motor therefore always starts, that is, regardless of the axial position of the shaft.

The expanding device preferably comprises a compression spring. Several compression springs may, of course, also be provided. This compression spring or springs are then arranged between the pressure-applying device and the pressure plate and press these two parts apart.

Although the expanding device can be provided on both axial sides of the cylinder drum, an especially advantageous construction provides for the expanding device to pass right through the cylinder drum. When the expanding device is arranged on both sides of the cylinder drum, the cylinder drum forms a part of the expanding device, for example, a stop member for the said compression spring. In that case, an axial play of the cylinder drum would be allowed. The ratios of the forces with which the pressure-applying device on the one hand and the pressure plate on the other hand are loaded, would, however, change in dependence on the position of the cylinder drum. This is generally immaterial, since the axial movements of the cylinder drum are only within the range of millimeters. If, however, the expanding device passes right through the cylinder drum, the expanding force does not depend on the axial position of the cylinder drum. Displacement of the cylinder drum does not increase the force on the one side and decrease the force on the other side. This naturally also applies whenever the expanding device passes around the outside of the cylinder drum.

The pressure-applying arrangement preferably comprises an apertured plate through which the slider shoe of each piston passes, and a spherical bearing element, which bears from the side facing away from the swash plate against the apertured plate; the expanding device here acts on the bearing element. The bearing element forms, as it were, a central point of action on the apertured plate, so that it is possible using simple means to achieve a mutual engagement of pressure-applying device and pressure plate, without further structural supporting measures being necessary.

An axial stop is preferably provided for a movement of the cylinder drum in a direction towards the control plate.

This axial stop forms a defined limitation for the movement of the shaft and consequently for the movement of the cylinder drum.

It is here especially preferred for the pressure plate to have a stop face for the cylinder drum. This creates a defined engagement facility for the cylinder drum on the pressure plate.

In a preferred alternative construction, provision is made for the axial stop to be formed by a part that is fixed on the shaft at least in the axial direction and engages against a part built into the housing. Whereas in the case of the first alternative an increase in the forces between the pressure plate and the control plate may occur on movement of the cylinder drum onto the control plate, which leads to a corresponding increase in the frictional forces between pressure plate and control plate, these forces are absorbed at least partly by the part fixed on the shaft, which engages against the part built into the housing. For example, the part fixed on the shaft can be formed by a ring secured to the shaft which is able to be brought into engagement against a corresponding axial bearing in the housing. In that case, a relatively high compressive stress on the control plate is avoided.

It is also preferred for the shaft to be loaded permanently with a force directed from the control plate to the swash plate. In that case, the cylinder drum maintains a defined position of rest.

Each cylinder is preferably connected to the pressure plate by way of a plug-like connector, which is mounted so as to be axially movable in the cylinder and/or in the pressure plate. The plug-like connector enables a fluid-tight connection to be produced between the through-opening in the pressure plate and the cylinder using very simple measures.

The invention is described hereinafter with reference to preferred embodiments and in conjunction with the drawings, in which

DESCRIPTION OF THE PREFERRED EMBODIMENTS

Figure 1:
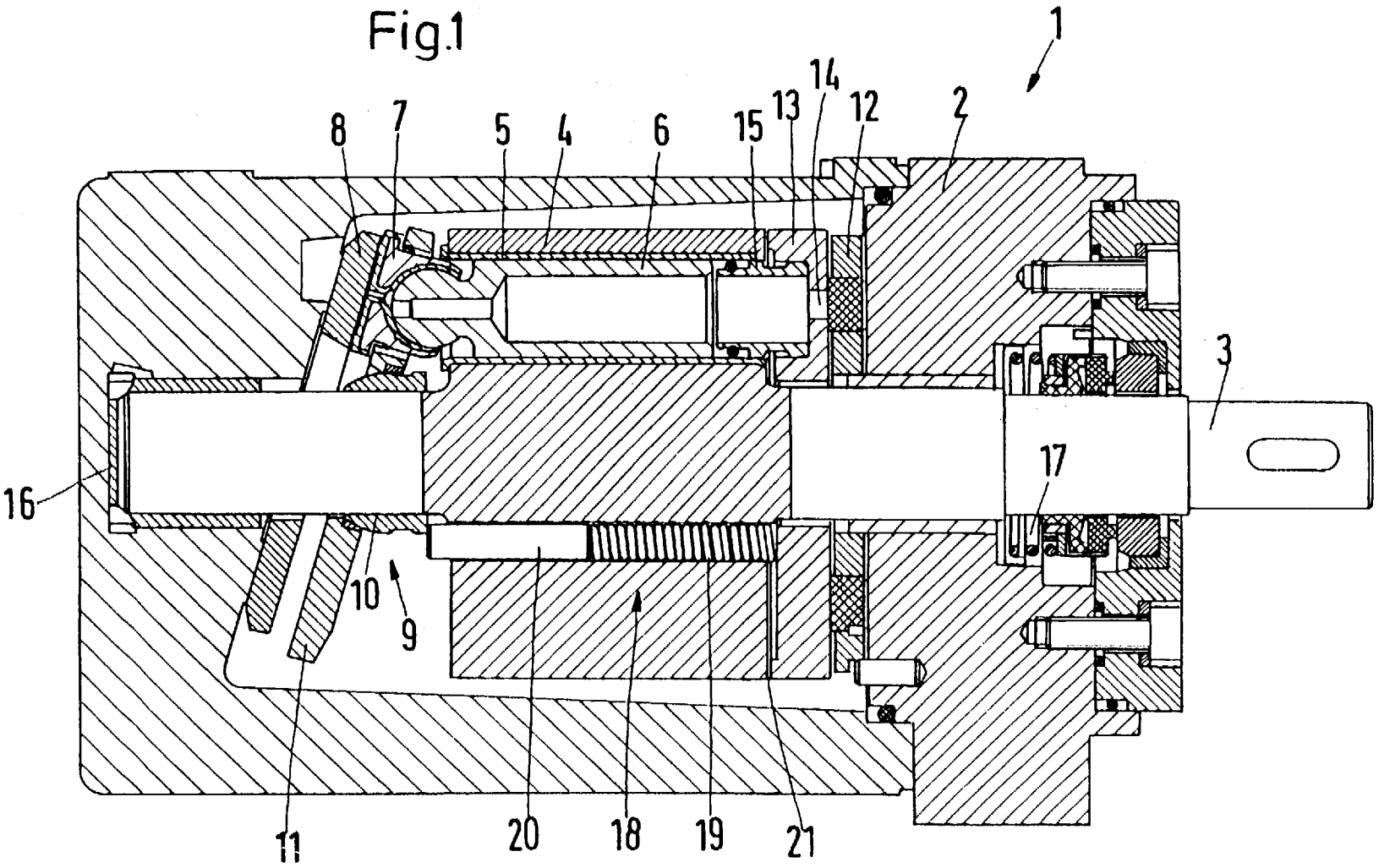
FIG. 1 shows a plan new partially in section of a first construction for a motor.

A motor 1 has a shaft 3 mounted in a housing 2; a cylinder drum 4 is connected to the shaft so that it is non-movable axially and so that they rotate together. Several cylinders 5, one of which is illustrated, are provided in the cylinder drum 4. In each cylinder 5 a piston 6 is arranged to be movable back and forth. The piston 6 projects at one end (at the left in the drawing) from the cylinder drum 4. It is supported there on a swash plate 8 by way of a slider shoe 7. In this particular embodiment, the swash plate 8 has a fixed angle of inclination. This can, however, instead be variable.

The slider shoes 7 are held in engagement on the swash plate 8 by means of a pressure-applying device 9, the pressure-applying device 9 being formed by a spherical bearing 10, which is arranged so as to be axially displaceable on the shaft 3, and by an apertured plate 11 which lies on the bearing 10. On rotation of the cylinder drum 4, the apertured plate 11 swivels continuously on the bearing 10.

On the other axial side of the cylinder drum 4 there is arranged a control plate 12 which in known manner (see for example, DE 43 01 134 A1) has control kidneys, not shown, which are connected to inlet and outlet channels, also not shown. Between the control plate 12 and the cylinder drum 4 there is arranged a pressure plate 13 which has a through-opening 14 for each cylinder. Each through-opening 14 passes over the control kidneys as the cylinder drum 4 rotates. Each through-opening 14 is connected by way of a plug-like connector 15 to its respective cylinder 5. The plug-like connector 15 is non-movably arranged in the cylinder 5. It can, however, be displaced axially with respect to the pressure plate 13, so that a certain axial movement between the pressure plate 13 and the cylinder drum 4 is allowed. In every axial position, however, the plug-like connector 15 ensures a fluid-tight path from the control kidneys of the control plate 12 to the interior of the cylinder 5.

At that end of the shaft 3 passing through the apertured plate 11 and the swash plate 8 there is an axial bearing 16. At the other end, a compression spring 17 which biasses the shaft 3 towards this axial bearing 16 is provided in the housing.

Between the pressure-applying device 9 and the pressure plate 13 there is an expanding device 18, which is formed by a compression spring 19 and a pusher rod 20. Here, the compression spring 19 bears at one end against the pressure plate 13 and at the other end bears by way of the pusher rod 20 against the bearing 10 of the pressure-applying device 9. Of course, the compression spring could also go right across. It could also be provided with pusher rods to bear against on both sides. Ultimately, two compression springs with a pusher rod between them could be provided; the pusher rod could even be a part of the cylinder drum 4. It is important only that the compression spring 19 (or the corresponding compression springs) are of such dimensions that in every admissible axial position they exert oppositely directed forces on the pressure-applying device 9 on the one hand and on the pressure plate 13, so that the pressure-applying device 9 is pressed toward the swash plate 8 and the pressure plate 13 is pressed towards the control plate 12.

In the embodiment illustrated, it is exclusively the thickness of the compression spring 19 which determines the degree of contact pressure. The expanding device 18 here, in fact, passes through the cylinder drum 4, that is, the axial position of the cylinder drum has no influence on the force of the spring 19. If springs 19 were to bear at both end faces of the cylinder drum 4, it would be a different matter. In that case if the cylinder drum 4 were to be displaced to the left, a somewhat larger force would be exerted on the pressure-applying device 9 while the force on the pressure plate 13 would drop. On movement to the right, (relative to the position in the drawing), this would be reversed. If the spring is suitably dimensioned, this is harmless, however, because the cylinder drum 4 is able to move only within the range of a few millimeters.

The expanding device 18 also ensures that irrespective of the axial position of the cylinder drum 4, a satisfactory contact pressure of the pressure plate 13 on the control plate on the one hand and of the slider shoes 7 on the swash plate 8 on the other hand is maintained. The motor 1 can therefore be operated in any position.

The movement of the cylinder drum 4 towards the control plate 12 is limited by a stop face 21 on the pressure plate 13. Further movement of the cylinder drum 4 towards the control plate 12 is not possible. But if loading of the shaft 3 in this direction increases, an increase in pressure on the control plate 12 is possible.

Figure 2:
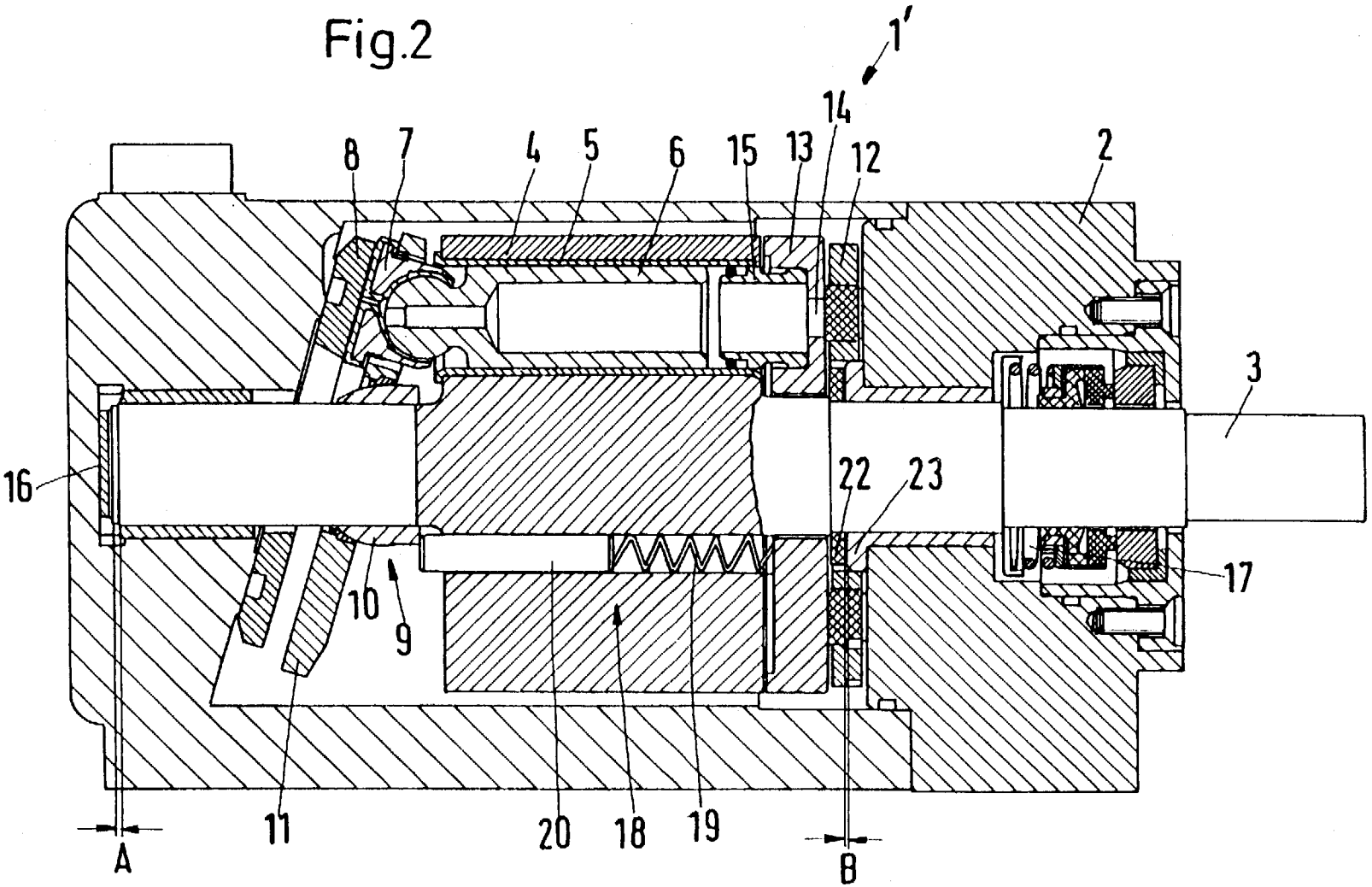
FIG. 2 shows a plan new partially in section of a second construction for a motor.

In order to limit this increase in pressure, in FIG. 2, in which identical parts have been denoted by the same reference numbers, a motor 1' is provided with a stop 22 fixed to the shaft in the axial direction, which is able to bear against a corresponding housing stop 23. The stop 22 restricts the movement of the shaft 3 and thus of the cylinder drum 4 in the direction towards the control plate 12, without excessively large forces being able to act on the control plate 12.

The cylinder drum 4 together with the shaft 3 are here illustrated in a position in which they have a freedom of movement A towards the left and a freedom of movement B to the right. The sum of the freedom of movement A+B is of the order of 0.5 to 1.5 mm, but in most cases is simply dependent only on manufacturing tolerances.

I claim:

1. A hydraulic axial piston motor having a housing, a cylinder drum in said housing which is connected, so that it is non-movable axially, to a shaft so that the drum and the shaft rotate together, said drum having at least one cylinder, a piston located in said one cylinder, which piston bears at an end projecting from the cylinder drum against a swash plate through a slider shoe, a pressure-applying arrangement for holding the slider shoe against the swash plate and a control plate, the pressure-applying arrangement mounted so as to be axially movable relative to the cylinder drum, a pressure plate axially movable relative to the cylinder drum located between the control plate and the cylinder drum, said pressure plate having for each cylinder a through-opening which is connected in a fluid-tight manner to the cylinder, means for loading the shaft permanently with a force directed from the control plate towards the swash plate, and an expanding device, led through or around the cylinder drum, which acts on the pressure-applying device and the pressure plate with oppositely directed forces between the pressure-applying device and the pressure plate.

2. A hydraulic axial piston motor having a housing, a cylinder drum in said housing which is connected, so that it is non-movable axially, to a shaft so that the drum and the shaft rotate together, said drum having at least one cylinder, a piston located in said one cylinder, which piston bears at an end projecting from the cylinder drum against a swash plate through a slider shoe, a pressure-applying arrangement for holding the slider shoe against the swash plate and a control plate, the pressure-applying arrangement mounted so as to be axially movable relative to the cylinder drum, a pressure plate axially movable relative to the cylinder drum located between the control plate and the cylinder drum, said pressure plate having for each cylinder a through-opening which is connected in a fluid-tight manner to the cylinder, said cylinder is connected to the pressure plate by means of a plug-like connector, which is mounted in one of the cylinders and arranged in the pressure plate so as to be axially movable, and an expanding device, led through or around the cylinder drum, which acts on the pressure-applying device and the pressure plate with oppositely directed forces between the pressure-applying device and the pressure plate.

* * * * *